US012203734B2

(12) United States Patent
Parker et al.

(10) Patent No.: US 12,203,734 B2
(45) Date of Patent: Jan. 21, 2025

(54) PROJECTILE WITH EW PAYLOAD

(71) Applicant: Insights International Holdings, LLC, Franklin, VA (US)

(72) Inventors: Evan Dale Parker, Franklin, VA (US); Linda Nelson, Redmond, OR (US); Neil Brennan, Newport News, VA (US)

(73) Assignee: Insights International Holdings, LLC, Franklin, VA (US)

( * ) Notice: Subject to any disclaimer, the term of this patent is extended or adjusted under 35 U.S.C. 154(b) by 0 days.

(21) Appl. No.: 18/244,148

(22) Filed: Sep. 8, 2023

(65) Prior Publication Data

US 2024/0302143 A1 Sep. 12, 2024

Related U.S. Application Data

(60) Provisional application No. 63/451,294, filed on Mar. 10, 2023.

(51) Int. Cl.

| | |
|---|---|
| ***F42B 12/36*** | (2006.01) |
| ***F42C 9/16*** | (2006.01) |
| *F41H 13/00* | (2006.01) |

(52) U.S. Cl.

CPC ..... *F42B 12/365* (2013.01); *F42C 9/16* (2013.01); *F41H 13/0093* (2013.01)

(58) Field of Classification Search

CPC ..... F42B 12/365; F42B 12/382; F42B 12/385
USPC ..... 102/501; 89/1.11
See application file for complete search history.

(56) References Cited

U.S. PATENT DOCUMENTS

| | | | | |
|---|---|---|---|---|
| 4,682,172 | A | 4/1987 | Kuhrdt | |
| 6,697,008 | B1 * | 2/2004 | Sternowski | G01S 7/38 342/353 |
| 9,524,648 | B1 | 12/2016 | Gopalakrishanan et al. | |
| 11,248,891 | B2 | 2/2022 | Koontz et al. | |
| 11,644,289 | B2 | 5/2023 | Parker et al. | |
| 11,846,495 | B2 | 12/2023 | Parker | |
| 2008/0198060 | A1 * | 8/2008 | Shani | H01Q 1/286 342/14 |
| 2011/0100201 | A1 | 5/2011 | Bass | |

(Continued)

FOREIGN PATENT DOCUMENTS

| | | | | |
|---|---|---|---|---|
| WO | WO-2021034424 | A2 * | 2/2021 | F41H 13/0093 |
| WO | WO-2021203162 | A1 * | 10/2021 | B64C 3/40 |

OTHER PUBLICATIONS

International Search Report for International Patent Application PCT/US2024/018609, dated Jun. 28, 2024, 4 pages.

(Continued)

*Primary Examiner* — Bret Hayes
(74) *Attorney, Agent, or Firm* — Fish IP Law, LLP; Tomas A. Prieto

(57) ABSTRACT

A system for deploying an electronic warfare package includes a projectile having an electronics payload for deployment in an environment. The electronics payload includes a processor and components that allow it to monitor an environment and initiate electronic warfare functions based on detecting a condition. The electronic payload also includes components that allow it to emit electronic signals for communication and/or disruption that can interfere with or otherwise affect local communications and computing devices.

10 Claims, 3 Drawing Sheets

(56) References Cited

U.S. PATENT DOCUMENTS

| | | | |
|---|---|---|---|
| 2018/0292184 | A1 | 10/2018 | Down et al. |
| 2023/0043724 | A1 | 2/2023 | Morrow et al. |

OTHER PUBLICATIONS

Written Opinion of the International Searching Authority for International Patent Application PCT/US2024/018609, dated Jun. 28, 2024, 4 pages.

* cited by examiner

PROJECTILE WITH EW PAYLOAD

This application claims priority to U.S. provisional application No. 63/451,294, filed Mar. 10, 2023. U.S. provisional application No. 63/451,294 and all other extrinsic references contained herein are incorporated by reference in their entirety.

FIELD OF THE INVENTION

The field of the invention is electronic warfare ("EW") delivery systems.

BACKGROUND

The background description includes information that may be useful in understanding the present invention. It is not an admission that any of the information provided herein is prior art or relevant to the presently claimed invention, or that any publication specifically or implicitly referenced is prior art.

As technology advances, so does its role in combat. Armed forces are becoming increasingly supported by advances in communication that empower forces to communicate better, faster and exchange information clearer than ever before. The use of drones in warfare has recently been demonstrated as game-changing, with the ability to quickly and inexpensively obtain reliable real-time audio and video data of an enemy's position. The use of mobile satellite internet platforms has enabled a defending force to sustain communications with command even after the substantial destruction or disruption of traditional communication networks.

As armed forces become increasingly empowered and dependent on communication technologies for their successful operations, there is a growing need to be able to disrupt an enemy's communications and other computing capabilities.

Because communications disruption requires a significant amount of power, existing solutions for disrupting communications have a large form factor and are generally imprecise. This makes it challenging to incorporate the element of surprise and to precisely control where and when the disruption takes place.

Thus, there is still a need for a precise method of deploying electronic warfare capabilities that allow an operator the control to dictate the where and the when of the disrupting effects.

SUMMARY OF THE INVENTION

The inventive subject matter provides apparatus, systems and methods in which a projectile carries an electronics payload that can perform electronic warfare functions. The electronics payload can include a processor, an RF tuner, an output oscillator, an input and an output antenna and a power source such as a battery. The processor is programmed to receive a signal in a frequency and generate a disruptive signal in that same frequency. The output oscillator then emits the disruptive signal via the output antenna.

In embodiments of the inventive subject matter, the processor can, via the output antenna or other communications interface, establish a connection with a computing device within communications range and upload a malware package to the computing device.

In embodiments of the inventive subject matter, the processor is programmed to only power on the electronics payload when a condition is met. This condition can include a date/time condition, an elapsed time (e.g., a timer) expiring condition, a location condition, or a combination of a time and location condition.

In embodiments of the inventive subject matter, the system does not include an input antenna or RF tuner. This simpler design lacks the capability to detect external radio signals and instead is powered on due to internal conditions being met (a timer, accelerometer reading, etc.).

Various objects, features, aspects and advantages of the inventive subject matter will become more apparent from the following detailed description of preferred embodiments, along with the accompanying drawing figures in which like numerals represent like components.

All publications identified herein are incorporated by reference to the same extent as if each individual publication or patent application were specifically and individually indicated to be incorporated by reference. Where a definition or use of a term in an incorporated reference is inconsistent or contrary to the definition of that term provided herein, the definition of that term provided herein applies and the definition of that term in the reference does not apply.

The description discussed herein includes information that may be useful in understanding the present invention. It is not an admission that any of the information provided herein is prior art or relevant to the presently claimed invention, or that any publication specifically or implicitly referenced is prior art.

In some embodiments, the numbers expressing quantities of ingredients, properties such as concentration, reaction conditions, and so forth, used to describe and claim certain embodiments of the invention are to be understood as being modified in some instances by the term "about." Accordingly, in some embodiments, the numerical parameters set forth in the written description and attached claims are approximations that can vary depending upon the desired properties sought to be obtained by a particular embodiment. In some embodiments, the numerical parameters should be construed in light of the number of reported significant digits and by applying ordinary rounding techniques. Notwithstanding that the numerical ranges and parameters setting forth the broad scope of some embodiments of the invention are approximations, the numerical values set forth in the specific examples are reported as precisely as practicable. The numerical values presented in some embodiments of the invention may contain certain errors necessarily resulting from the standard deviation found in their respective testing measurements.

Unless the context dictates the contrary, all ranges set forth herein should be interpreted as being inclusive of their endpoints and open-ended ranges should be interpreted to include only commercially practical values. Similarly, all lists of values should be considered as inclusive of intermediate values unless the context indicates the contrary.

As used in the description herein and throughout the claims that follow, the meaning of "a." "an," and "the" includes plural reference unless the context clearly dictates otherwise. Also, as used in the description herein, the meaning of "in" includes "in" and "on" unless the context clearly dictates otherwise.

The recitation of ranges of values herein is merely intended to serve as a shorthand method of referring individually to each separate value falling within the range. Unless otherwise indicated herein, each individual value is incorporated into the specification as if it were individually recited herein. All methods described herein can be performed in any suitable order unless otherwise indicated herein or otherwise clearly contradicted by context. The use of any and all examples, or exemplary language (e.g. "such as") provided with respect to certain embodiments herein is intended merely to better illuminate the invention and does not pose a limitation on the scope of the invention otherwise claimed. No language in the specification should be construed as indicating any non-claimed element essential to the practice of the invention.

Groupings of alternative elements or embodiments of the invention disclosed herein are not to be construed as limitations. Each group member can be referred to and claimed individually or in any combination with other members of the group or other elements found herein. One or more members of a group can be included in, or deleted from, a group for reasons of convenience and/or patentability. When any such inclusion or deletion occurs, the specification is herein deemed to contain the group as modified thus fulfilling the written description of all Markush groups used in the appended claims.

DETAILED DESCRIPTION

Figure 1:
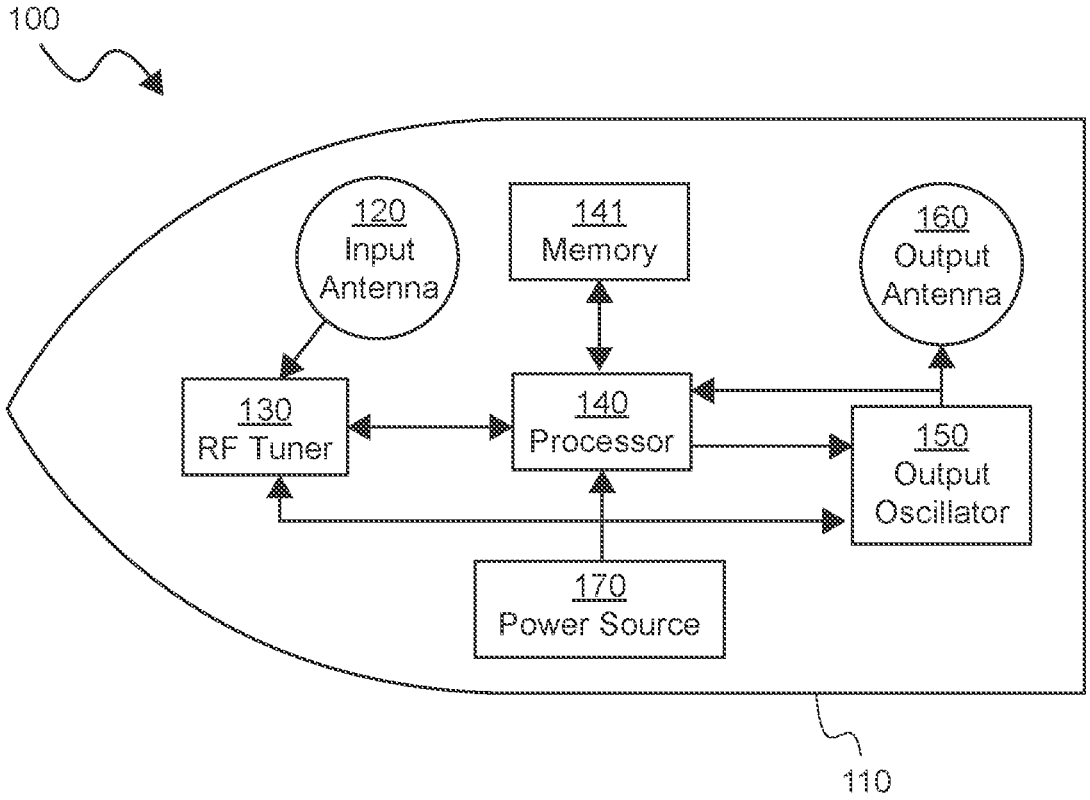
FIG. 1 is a diagrammatic overview of an electronic warfare ("EW") projectile, according to embodiments of the inventive subject matter.

It should be noted that any language directed to a computer should be read to include any suitable combination of computing devices, including servers, interfaces, systems, databases, agents, peers, engines, controllers, or other types of computing devices operating individually or collectively. One should appreciate the computing devices comprise a processor configured to execute software instructions stored on a tangible, non-transitory computer readable storage medium (e.g., hard drive, solid state drive, RAM, flash, ROM, etc.). The software instructions preferably configure the computing device to provide the roles, responsibilities, or other functionality as discussed below with respect to the disclosed apparatus. In especially preferred embodiments, the various servers, systems, databases, or interfaces exchange data using standardized protocols or algorithms, possibly based on HTTP, HTTPS, AES, public-private key exchanges, web service APIs, known financial transaction protocols, or other electronic information exchanging methods. Data exchanges preferably are conducted over a packet-switched network, the Internet, LAN, WAN, VPN, or other type of packet switched network.

One should appreciate that the disclosed techniques provide many advantageous technical effects including the ability to covertly deploy EW assets and then activate them at a time and for a duration of an operator's choosing.

The following discussion provides many example embodiments of the inventive subject matter. Although each embodiment represents a single combination of inventive elements, the inventive subject matter is considered to include all possible combinations of the disclosed elements. Thus if one embodiment comprises elements A, B, and C, and a second embodiment comprises elements B and D, then the inventive subject matter is also considered to include other remaining combinations of A, B, C, or D, even if not explicitly disclosed.

As will be described herein, the electronic warfare "EW" packages discussed in the embodiments of the inventive subject matter can generally be categorized as a signal jammer or an intrusive disruptor. The first embodiments will discuss the signal jammer that disrupts communications by interfering or otherwise disrupting the communications signals used by devices, with the later embodiments discussing the intrusive disruptor that functions to disrupt communications by introducing a virus or other harmful code into the devices themselves.

It is contemplated that beyond disruption or jamming, the systems and methods of the inventive subject matter can include a projectile that can also perform disabling (e.g., EMP, degrading, detraction, deception, interceptions and hijacking functions.

The function of a signal jammer is to interfere between the emitter and receiver of a wireless transmission. This can be accomplished by simply adding noise to the wireless link between the devices; however, there are also more complex ways to create interference, for instance sending specific information that confuses the communication protocol on any end of the wireless link (the attack can be targeted at the emitter or receiver).

Examples of types of existing cellphone jammers can be seen as:

- Type A: A device that overcomes the cellphone receiving signal by emitting multiple powerful frequencies that impede the wireless communication.
- Type B: A device that detects when a call is being made and communicates with the base station, informing it to prohibit the call establishment. This device can, for instance, recognize emergency calls and allow them to go through.
- Type C: A device which operates as a beacon and inform all nearby devices to disable their ringer operation.
- Type D: A device that communicates directly with a nearby phone and prevents it from making or receiving calls. Emergency calls can be allowed by this device.
- Type E: Faraday cages, which are not relevant to the embodiments of the inventive subject matter discussed herein.
- Type F a device that sends energy and destroy or disables other electronic devices.

The embodiments discussed herein are principally Type A devices but can, in embodiments, also incorporate functions of some of the other types.

The type of jamming attack can be also categorized and the effectiveness of the attack can depending on the type. The most significant types of jamming attacks are:

- Constant: This attack simply sends random information all the time without knowing if the channel is busy or not.
- Deceptive: This attack sends also information all the time but it does so in a way the other emitters are tricked into thinking they should be in receive mode. A variation of this can be that a device sends incorrect data and information to have an enemy device give incorrect information (e.g., with false location data, IP addresses, etc.)
- Random: This attack is random in the way it activates and deactivates the signal noise.
- Reactive: This attack stays quiet when the other emitters are idle and once a transmission is detected then it sends noise.

Reactive: This attack displays better results than the random jammer only for short distances but it is important to note this jamming method is harder to detect.

There are multiple strategies to avoid signal jamming but they are usually complex to implement and, in short, a signal jammer is hard to avoid. As was noted before, one of the main strategies to accomplish signal jamming implies adding noise to the frequency where the communication is occurring at a higher power than the original signal, since some protocols have built in mechanisms to jump between frequencies (also known as frequency hopping) when they detect problems in the communication channel (like 2G, 3G and such); some jammers emit noise at multiple frequencies, however, this approach has its own faults since some wireless protocols can use more than 50 channels and therefore the jammer has to emit every channel frequency. Another approach for type A devices is to detect the communicating frequency and emit noise at the same frequency, this way the power of the device can be focused in a specific channel (as the reactive attack approach).

Type A jammers have to emit different frequencies at a high power in order to eclipse the real communicating signal (regardless if the jammer will detect the communicating frequency) this is why some commercial jammers' battery doesn't last very long even when they emit intermittingly. This implies one of the main components will have to be a signal generator of the same frequency of the target to block; if the jammer aims to block different communication protocols that operate at different frequencies then it would require multiple generators and multiple antennas, this is why some commercial jammers have many antennas.

As said before the jammer will have to emit noise at high power, this implies the power source will have to be able to deliver enough energy to the signal generators in order to maintain the jamming attack and successfully block all attempts of reconnection. A battery powered jammer will have to take into account the duration of the attack and the dBm of the output antenna for each one of the protocols it aims to attack; this will give a good estimate of the expected battery life for such conditions.

If the jammer uses an input antenna to be able to determine the current frequency where the communication is occurring then it will have to incorporate also a filter that omits the frequency its own transmitter emits, otherwise the jammer will be locked in just the first frequency it detects and when a frequency hopping occurs the jammer wouldn't be able to recognize such change. If a jammer has an input antenna it doesn't mean it will have to use this kind of filters, it can simply emit short burst of noise and then change to receiver mode (even using the same antenna) but this strategy could prove not so effective (it would be as effective as the random attack).

The systems and methods of the inventive subject matter include an EW payload internal to a projectile that can be deployed via firearms or other suitable launchers into a desired area where the EW payload can be activated.

In embodiments of the inventive subject matter, the EW payload of a projectile can include an input antenna that enables it to perform random, deceptive, constant or reactive attacks. FIG. 1 is a diagrammatic overview of this embodiment of the inventive subject matter.

As seen in FIG. 1, the EW delivery system 100 includes a projectile body 110 that houses the EW payload. The projectile body 110 can be considered to be of a sufficient size to house the EW payload. The projectile body 110 is of a standard size/caliber/type to be fired by existing weapons. It is contemplated that the projectile body 110 can be a projectile of any known bullet calibers and sizes (e.g., .50 caliber, .22 caliber, etc.), or be a projectile body of a size and dimension of a projectile larger than bullets (e.g., mortars, missiles, grenade launchers-based ordnance, etc.). For example, a desirable form factor for the projectile body 110 is that of a 40 mm grenade projectile that can be fired by a launcher such as a rifle-based underside launcher or dedicated grenade launcher.

The EW payload is a general term used for the collection of components that enable for the identification of local signals and/or local networks, local jamming of communication signals, interception of local communication signals, distraction and/or deception of local networks, infiltration/penetration and/or hijacking of local networks. In the embodiment shown in FIG. 1, the EW payload includes an input antenna 120, an RF tuner 130, a processor 140, an output oscillator 150, and an output antenna 160. The EW payload also includes a power source 170 (e.g., a battery) that powers the various components included herein.

Figure 2:
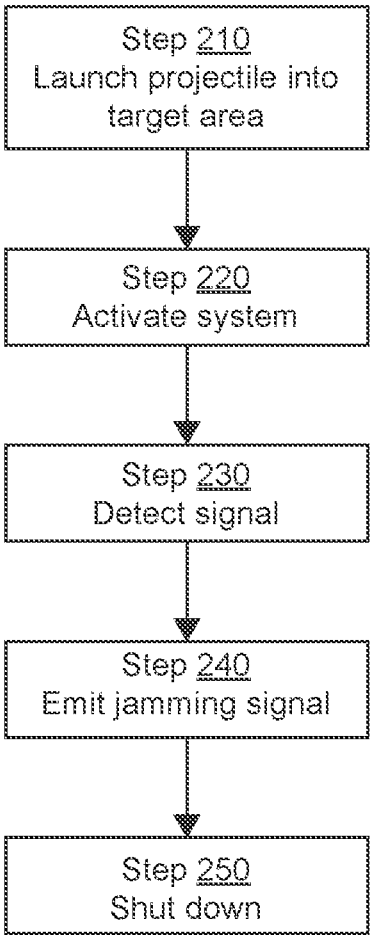
FIG. 2 shows an example flowchart of the operation of a projectile 110, according to embodiments of the inventive subject matter.

FIG. 2 depicts a possible diagram of components needed for every frequency that is desired to block. However, not all the specified components are necessary for all applications and some of them could be used for multiple frequencies without the need of more components.

Input Antenna 120: This component is not necessary if the system will only emit noise (which will be discussed further below). The input antenna 120 is of an appropriate length to better catch incoming transmissions of certain frequencies. This component by itself doesn't drain current. It is necessary for every frequency that is to be blocked if they are significantly distant from each other and they can be used as an additional output antenna if it connected it to the output oscillator 150. In embodiments of the inventive subject matter, the system 100 can include more than one input antenna 120 so as to be able to handle multiple frequencies.

RF Tuner 130: The RF tuner 130 is configured to receive incoming transmissions using the input antenna. In embodiments, the RF tuner 130 could be activated or deactivated by the processor 140 according to certain conditions (e.g., as schedule, etc.) or it could stay always on. There must be an RF tuner 130 for each input antenna 120. In embodiments, the RF Tuner 130 and processor 140 can be integral to one unit.

Processor 140: The processor 140 is the component which takes the received signal from the RF tuner 130 and, based on the received signal, generates another signal at the same frequency (when it passes through the output oscillator 150) but with different information. The processor 140 can be as basic as a noise generator or it could include filters, DSP analyzers, signal generators and so on. This component could be analog or digital, but in some cases it is recommended to be analog if the jamming signal has to be emitted very fast to block the original. The number of processors 140 could be as many as frequencies to attack or only one for all the signals.

The system can also include an on-board memory 141 that stores executable instructions that the processor 140 is programmed to execute. The memory 141 can also store data related to the functions of the inventive subject matter. For example, data associated with a date/time of activation, one or more frequencies to be blocked, reporting instructions, and other data.

In embodiments of the inventive subject matter, the system 100 is initiated prior to launching. In other embodiments, the processor 140 can be programmed to activate the system 100 upon a certain conditions being met. For example, the system 100 can be activated upon detecting (via an accelerometer or other on-board sensor) that the projectile 110 has been launched. Other types of conditions can include determining a particular location based on on-board location hardware (such as GPS), a time trigger (e.g., initiating based on date/time, or the expiration of a timer), a combination of location and time trigger, etc.

Output Oscillator 150: The output oscillator 150 takes the signal generated by the processor and transforms it into a coherent signal to be transmitted through the output antenna 160; this component is always necessary but also could be combined with the processor 140, since some integrated circuits have both capabilities. An output oscillator 150 is necessary for each frequency to be transmitted, however there are multi-oscillators that are very competent in a wide range of frequencies.

Output Antenna 160: The Output Antenna 160 emits the signal. In embodiments, it can have all of the same characteristics of the input antenna 120.

Power Source 170: The power source 170 is simply the component which allows enough energy into each component so they can operate correctly. The power source 170 can be a battery. It is important to note that each circuit required for each frequency could inject noise to the other signal generators.

FIG. 2 shows an example flowchart of the operation of a projectile 110, according to embodiments of the inventive subject matter.

At step 210, the projectile 110 is launched into a target area.

At step 220, the processor 140 detects the satisfaction of a condition that causes it to activate the system. The condition can be a firing of the projectile 110 (detected via an accelerometer). Other conditions can include detecting that a certain date and/or time has been reached, a certain location has been reached (based on position information received from GPS), a combination of a time and a location. In embodiments of the inventive subject matter, the processor 140 and other components of the projectile 110 can be set to a passive mode where the processor 140 listens for signals and activates in response to detecting a signal (via the input antenna 120).

These embodiments allow for the projectile 110 to be launched into an area at a time prior to an anticipated use (days, weeks or months prior) such that the processor 140 and the other components do not become active until they are needed or desired. This preserves system resources such as battery life and reduces the chances of detection.

In embodiments of the inventive subject matter, the projectile can be activated prior to loading into a launcher, such that step 220 is performed by an operator prior to firing.

The operating logic executed by processor 140 for the system 100 of FIG. 1 is that as soon as it is powered it begins to scan for wireless transmissions at step 230. If it detects one then the processor 140 generates noise (or specific data) and then emits this signal through the output antenna 160 at step 240. The processor 140 can include an input notch filter that tracks the output oscillator frequency and effectively omits this frequency from the input antenna, by doing so, a change in the attacked frequency can be detected and the jammer can adjust accordingly. The processor 140 can also turn off the RF Tuner when it is transmitting and then turn it on once it has finished, this way the RF Tuner can still be used but only operates when the jammer is "quiet".

The signal emitted is one that can interfere with one or more of cellular communications, WiFi communications, NFC communications, Bluetooth communications or other wireless communications.

In embodiments of the inventive subject matter, the signal emitted is one that interferes with local receipt of global positioning signals from GPS or GLONASS, thus confusing location identification circuits in nearby devices or vehicles.

In embodiments of the inventive subject matter, the system can spoof signals such that other devices are deceived into connecting to the system 100 at which point the system 100 can disrupt, infiltrate or otherwise affect connected computing devices. For example, the processor 140 can be programmed to emit a signal in the area that mimics a previously-discovered signal. This can include mimicking a network name or address, a signal, etc.

In embodiments of the inventive subject matter, the processor 140 can shut the components down or go into a sleep mode after a certain pre-determined time or after it no longer detects the input signal present at step 250.

In embodiments of the inventive subject matter, a projectile 110 can network with other similar projectiles 110 such that the processor(s) 140 are programmed to cooperate. The cooperation can include dividing the frequencies of interest among the deployed projectiles 110 such that a plurality of frequencies are jammed by the plurality of deployed devices.

Figure 3:
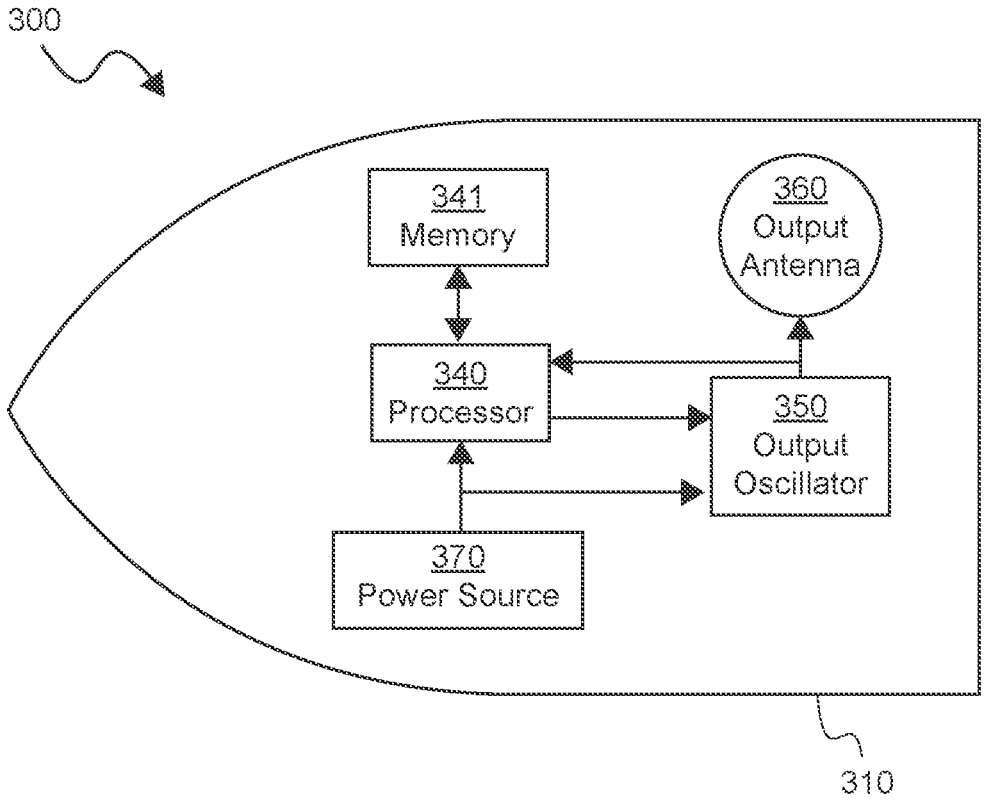
FIG. 3 shows a simpler design of a signal jammer, lacking the input antenna and RF tuner of FIG. 1.

The embodiment of FIG. 1 includes an input antenna that allows the processor 140 to detect signals and receive data. The system 300 of FIG. 3 is a simpler design of a signal jammer, lacking the input antenna and RF tuner of FIG. 1. The operating logic of the system 300 is that as soon as it is powered its processor 340 generates noise (or specific data) and then emits this signal through the output antenna 360. The processor 340 can emit programmed or endless transmissions. The output of the oscillator can be used as a feedback so the processor can re-adjust its output signal and better tune the attacked frequency. The components of the system 300 of FIG. 3 correspond to those same components of the system 100 of FIG. 1, except for the input antenna and RF tuner. The process of FIG. 2 can apply to the system 300 of FIG. 3 except for the steps that require an input antenna and RF tuner. Thus, instead of detecting a radio signal on site, the system 300 can initiate due to firing or via an accelerometer reading indicative that the projectile 310 has come to a stop.

In embodiments of the inventive subject matter, the housing of the projectile 110 can be used as the input antenna 120 or the output antenna 160 (for the embodiment of FIG. 1). Likewise, in embodiments of the inventive subject matter, the housing of the projectile 310 can be used as the output antenna 360. This approach is discussed in Applicant's U.S. patent application Ser. No. 17/487,990 titled "Ordnance Delivery System Using a Protective Housing as an Antenna", filed Sep. 28, 2021, which is incorporated herein by reference in its entirety.

In addition to the components above, the projectiles 110, 310 can include accelerometers or other sensors that can detect the movement of the projectile 110, 310, GPS equipment that can report position information to the processor 140, 340 and other sensors.

In embodiments of the inventive subject matter, the projectiles 110, 310 can be configured to establish a connection with a nearby computing device and upload malware to the computing device to disrupt communications or other functions. The malware deployed can include a virus, a trojan horse, a worm, ransomware, spyware, wipers, keyloggers, etc.

In embodiments of the inventive subject matter, the projectiles 110, 310 also include communication interfaces that allow for the transmission of data (and in the case of projectile 110, the receipt of data). This can include transmitting the data via the output antennas 160, 360 or via other antennas specific to a particular protocol. Examples of suitable communication interfaces can include WiFi, Cellular, Bluetooth, NFC, etc.

In embodiments of the inventive subject matter, the projectile 110, 310 can contain a self-destruct mechanism that can destroy or otherwise render inoperable the electronics component of the projectile 110, 310. The processor 140, 340 can initiate a self-destruct sequence in response to a trigger that causes the self-destruct mechanism to activate. In these embodiments, the trigger can be the projectile 110 receiving a self-destruct signal from an external device and thus initiate the self-destruct sequence. In another embodiment, the trigger can be the detection of a particular frequency. In these embodiments, processor 140 can be programmed to initiate the self-destruct sequence in response to detecting a particular pre-determined frequency. The device of FIG. 3 lacks the input antenna so it cannot receive the external command or detect the external frequency. In other embodiments, the trigger can be a preprogrammed timer or elapsed date/time such that projectile 110, 310 can be set to self-destruct on a timer or at a specific date/time that is set/programmed prior to launch or deployment.

In embodiments, the self-destruct mechanism can include an amount of an explosive material that the processor 140, 340 can trigger to ignite. Thus, the self-destruct sequence can be considered to be the ignition of the explosive by the processor 140, 340. In variations of this embodiment, the explosive material can be of a magnitude that it completely destroys the EW payload but does not penetrate outside of the projectile 110, 310 body itself. This way, if the projectile 110, 310 is discovered later by an enemy, the true nature of the projectile 110, 310 is not discovered.

In embodiments, the self-destruct mechanism can include one or more chemicals that is released within the projectile that destroys or otherwise renders inoperable the electrical components contained within the projectile 110, 310. The chemical(s) can be stored in one or more enclosures or reservoirs within the projectile that can be punctured by a piercing mechanism that is controlled by the processor 140, 340. The chemical can be a corrosive chemical that damages, burns or otherwise destroys the sensitive electrical components within the projectile 110, 310. In embodiments of the inventive subject matter, the projectile 110, 310 can include two or more chemicals in separate enclosures that, when they come into contact with each other after their respective enclosures are punctured, cause a chemical reaction that results in the destruction of the electronics components. The chemical reaction can a burn or other destructive reaction. Thus, the self-destruct sequence in these embodiments is the processor causing the piercing mechanism to puncture the one or more chemical reservoirs that release the chemical to perform the destructive processes discussed above.

In embodiments of the inventive subject matter, the self-destruct mechanism can be an electrical signal such as an electrical spike within the projectile 110, 310 that damage the electronics components contained therein. In these embodiments, the processor 140, 340 can be programmed to execute the self-destruct sequence by causing the power source 170 to release a surge of voltage or wattage that results in the destruction of one or more of the electronics components in the projectile 110, 310.

Suitable methods of data exchange for projectile-based electronics components are described in the following U.S. patent applications owned by the applicant Ser. No. 17/487,990 filed Sep. 28, 2021, U.S. patent application Ser. No. 16/900,226 filed Jun. 12, 2020 and issued Feb. 15, 2022, U.S. patent application Ser. No. 17/004,895 filed Aug. 27, 2020 and U.S. patent application Ser. No. 17/845,273 filed Jun. 21, 2022. All of these patent applications are incorporated herein by reference in its entirety.

In embodiments of the inventive subject matter, the processors 140, 340 can be programmed to cause the emission of a short, powerful burst of signal to overwhelm nearby devices. The processors can be programmed to do this based on a timer from firing, based on receiving a signal (for projectile 110), or based on an altitude (with an on-board altimeter). In these embodiments, the projectile 110 can be used to intercept and potentially disable a moving target. For example, upon discovering a drone flying overhead, an operator can program the projectile 110, 310 to emit a strong signal at the approximate observed distance of the drone. This way, the signal can disable the drone as the projectile 110, 310 is within proximity of the drone without requiring a kinetic kill.

In embodiments of the inventive subject matter, the memory 141, 341 can store a "kill code" used for a particular machine. For example, a piece of equipment (e.g., a military vehicle, a weapons system, a car or other civilian vehicle) can a priori have a kill code programmed into its on-board computer such that if it receives the kill code, the on-board computer causes the piece of equipment to shut down.

In these embodiments, the projectile 110, 310 is shot or otherwise delivered within communications range of the target (the piece of equipment that is to be disabled). The processor 140, 340 begins transmitting the kill code upon the satisfaction of a certain condition (e.g., determining the projectile has stopped moving; for projectile 110, detecting a radio emission associated with the piece of equipment; based on a GPS signal, etc.). In response to the kill code, the piece of equipment is disabled.

In embodiments of the inventive subject matter, the projectile 110, 310 can contain an electromagnetic pulse ("EMP") emitter that can emit a pulse the can disable an electronic device in the vicinity. The processor 140, 340 can be programmed to fire the EMP emitter using similar logic to that of the deployment of the jamming signal above, as applicable: based on a received signal, based on a timer, based on a date/time, based on a location, based on a proximity to a device or vehicle, etc. (or a combination of these).

In embodiments of the inventive subject matter, the projectile 110, 310 can be programmed to deploy a shock or surge of voltage that could be used to disable a vehicle, equipment or personnel. In these embodiments, electrically-conductive connections can be coupled between the on-board power source and the electrically-conductive housing (or an electrically-conductive portion thereof) of the projectile 110, 310 such that the processor 140,340 can cause a discharge of electricity to an external body. In these embodiments, the processor 140, 340 can be programmed to discharge the electric shock via received commands (for projectile 110), via a timer, proximity, location, date/time, etc.

As used herein, and unless the context dictates otherwise, the term "coupled to" is intended to include both direct coupling (in which two elements that are coupled to each other contact each other) and indirect coupling (in which at least one additional element is located between the two elements). Therefore, the terms "coupled to" and "coupled with" are used synonymously.

It should be apparent to those skilled in the art that many more modifications besides those already described are possible without departing from the inventive concepts herein. The inventive subject matter, therefore, is not to be restricted except in the spirit of the appended claims. Moreover, in interpreting both the specification and the claims, all terms should be interpreted in the broadest possible manner consistent with the context. In particular, the terms "comprises" and "comprising" should be interpreted as referring to elements, components, or steps in a non-exclusive manner, indicating that the referenced elements, components, or steps may be present, or utilized, or combined with other elements, components, or steps that are not expressly referenced. Where the specification claims refers to at least one of something selected from the group consisting of A, B, C . . . and N, the text should be interpreted as requiring only one element from the group, not A plus N, or B plus N, etc.

What is claimed is:

1. A system for deployment of an electronic warfare package, comprising:

a projectile comprising:

an electronics payload comprising:

a processor;

an RF tuner communicatively coupled with the processor;

an output oscillator communicatively coupled to the processor and the RF tuner;

an input antenna communicatively coupled to the RF tuner;

an output antenna communicatively coupled to the output oscillator; and a power source;

wherein the processor is programmed to:

receive, from the input antenna and via the RF tuner, a signal detected in a first frequency;

generate a disruptive signal in the first frequency in response to the detected signal; and cause the output oscillator to emit the disruptive signal via the output antenna.

2. The system of claim 1, further comprising a memory storing at least one malware package, wherein the processor is further programmed to:

establish a connection with a computing device within communication range; and upload the at least one malware package to the computing device.

3. The system of claim 1, wherein the processor is programmed to power on the electronics payload based on a detected condition being met.

4. The system of claim 3, wherein the detected condition comprises at least one of: a date and time being met, an elapsed time expiring, location information matching a location, or location information and time information matching a location and a pre-determined time.

5. The system of claim 1, further comprising a self-destruct mechanism, wherein the processor is further programmed to:

in response to receiving a trigger, initiate a self-destruct sequence; and wherein initiating the self-destruct sequence comprises activating the self-destruct mechanism.

6. The system of claim 5, wherein the self-destruct mechanism comprises at least one of an explosive mechanism, a chemical mechanism or an electrical signal mechanism.

7. The system of claim 1, wherein the processor is further programmed to:

discover, via the input antenna, an existing communications signal; and generate, via the RF tuner, a mimic signal that mimics the discovered signal; and output, via the output antenna, the mimic signal.

8. The system of claim 1, wherein the disruptive signal comprises a deceptive signal.

9. The system of claim 8, wherein the deceptive signal comprises a signal that causes a second device to report incorrect data to additional devices.

10. The system of claim 1, further comprising at least one second projectile, the second projectile having a processor programmed to cooperate with the projectile.

* * * * *